United States Patent [19]

Takahashi et al.

[11] 3,943,901

[45] Mar. 16, 1976

[54] UNIT INJECTOR FOR A DIESEL ENGINE

[75] Inventors: Seiji Takahashi; Nobuhiro Kaibara, both of Higashi-Matsuyama, Japan

[73] Assignee: Diesel Kiki Kabushiki Kaisha, Tokyo, Japan

[22] Filed: Feb. 5, 1974

[21] Appl. No.: 439,724

[30] Foreign Application Priority Data

Feb. 19, 1973 Japan ..... 48-19228

[52] U.S. Cl. .... 123/139 AS; 123/139 AT; 417/392; 417/401

[51] Int. Cl.[2] ..... F02M 39/00

[58] Field of Search 123/139 AS, 139 AT, 139 AM, 123/139 AV; 417/392, 401

[56] References Cited

UNITED STATES PATENTS

| | | | |
|---|---|---|---|
| 1,528,779 | 3/1925 | Muller | 123/139 AS |
| 1,919,601 | 7/1933 | Simmen | 123/139 AS |
| 2,625,436 | 1/1953 | Berlyn | 123/139 AT |
| 3,516,395 | 6/1970 | Bassot | 123/139 AS |
| 3,699,939 | 10/1972 | Eckert | 123/139 AS |
| 3,789,818 | 2/1974 | Asbery | 123/139 AS |

*Primary Examiner*—Charles J. Myhre
*Assistant Examiner*—Daniel J. O'Connor
*Attorney, Agent, or Firm*—Henry R. Lerner

[57] ABSTRACT

A unit injector for a diesel engine wherein a spool valve body is connected with a pressurizing chamber in a main body so that fuel to be supplied from a fluid element is supplied into the pressurizing chamber to affect the injection stroke of a pump plunger and the spool valve is actuated by the supplied fuel pressure to be supplied by the fluid element.

7 Claims, 4 Drawing Figures

UNIT INJECTOR FOR A DIESEL ENGINE

This invention relates to a unit injector for a diesel engine provided with a fluid element.

Heretofore, electromagnetic type unit injectors have been developed. However, when such a conventional unit injector is used in an engine which requires a great amount of injection, an electromagnetic valve, which has a large capacity and can be responsive in less time, must be used and in addition since it is troublesome to manufacture such an electromagnetic valve as described above, it has been difficult to obtain an expected performance.

It is an object of this invention to eliminate the disadvantages of the unit injector provided with said electromagnetic valve.

Other objects and advantages of this invention will be apparent from the following description.

Figure 2:
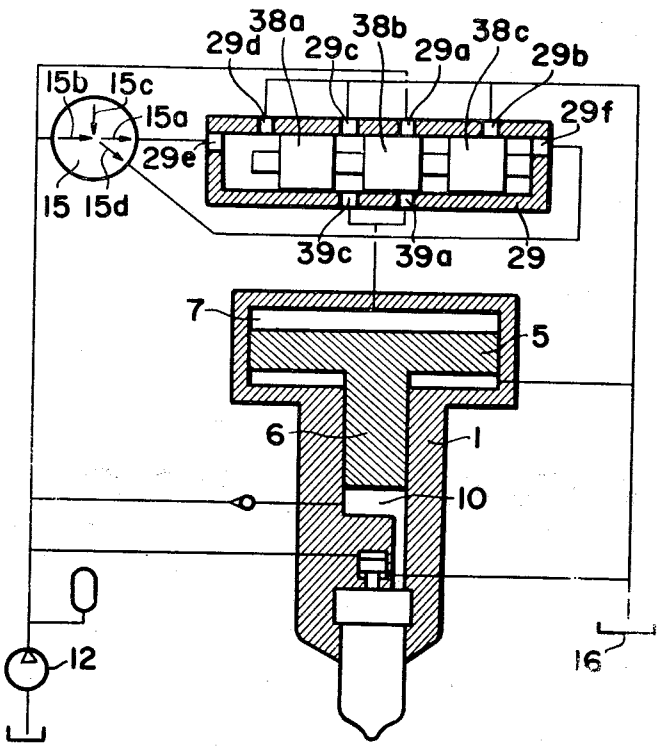
Figure 1:
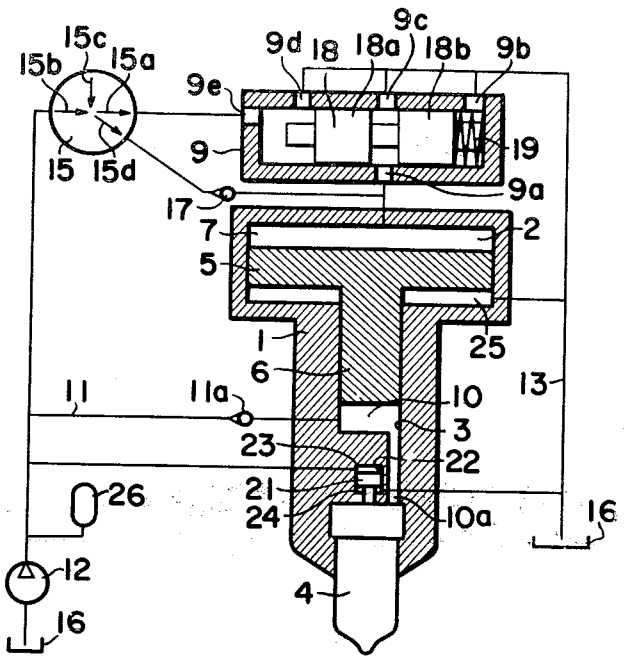
Figure 4:
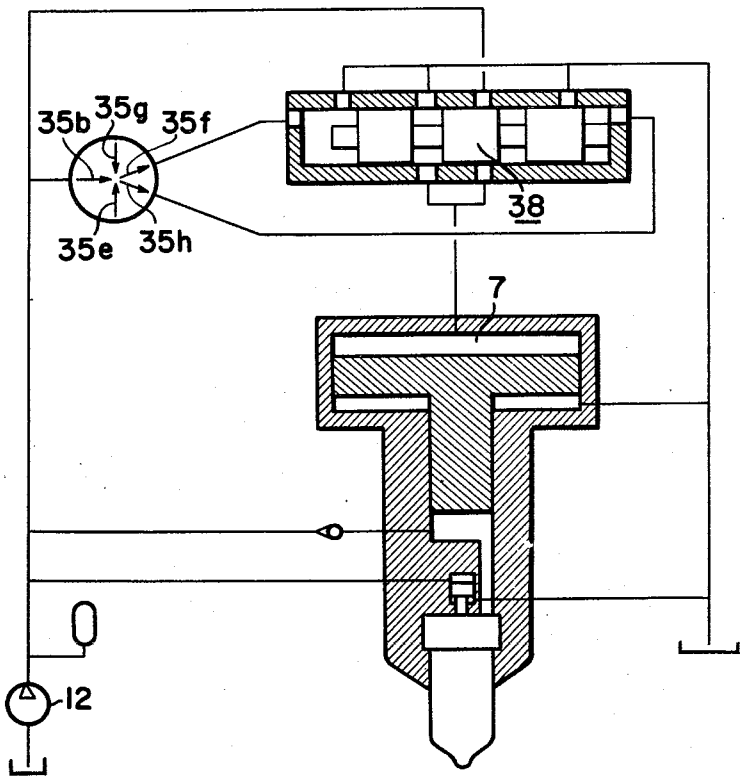
Figure 3:
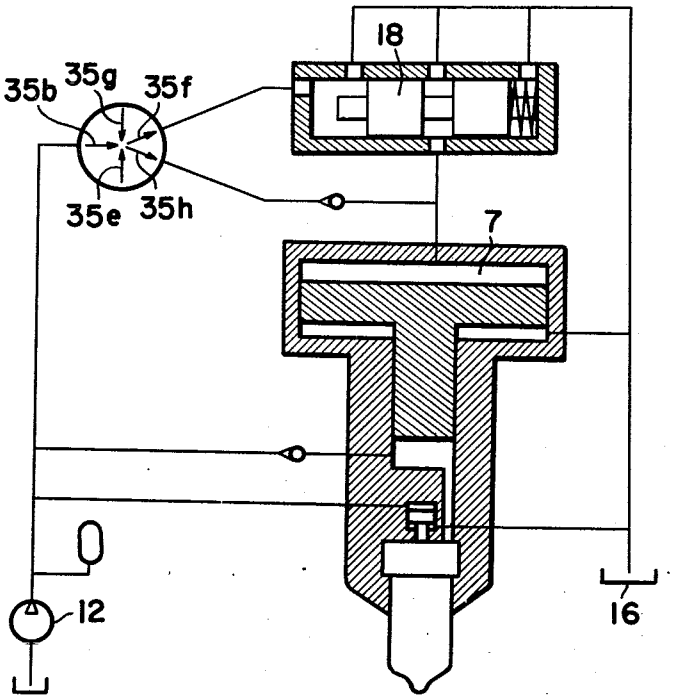

This invention will now be described with reference to some embodiments, reference being had to the accompanying drawing in which FIGS. 1 and 2 schematically illustrate embodiments of this invention using a monostable fluid element, and FIGS. 3 and 4 schematically illustrate embodiments of this invention using a bistable fluid element.

Within the injector body 1 there is formed a cylinder comprising a large diameter portion 2 and a small diameter portion 3, and an injection nozzle 4 is mounted at the extreme end of the small diameter portion in the cylinder. A servo-piston 5 is slidably fitted in the large diameter portion 2 and a pump plunger 6 integral with the servo-piston 5 is slidably fitted in the small diameter portion 3. A pressurizing chamber 7 is formed at the upper portion of the servo-piston 5 in the large diameter portion 2, this pressurizing chamber 7 being connected with an inlet 9*a* in a spool valve body 9 as a pilot valve. A pump plunger chamber 10 is formed at the lower end of the pump plunger 6 fitted in the small diameter portion 3 to connect with the injection nozzle 4 through a passage 10*a* and with an oil pump 12 through a pipe 11 provided with a check valve 11*a* which allows fuel to pass into the pump plunger chamber 10. Outlets 9*b*, 9*c* and 9*d* in the spool valve body 9 are connected with a drain pipe 13, and an inlet 9*e* is connected with a first output port 15*a* (when an input signal is not present) of a monostable fluid element 15. The drain pipe 13 is connected with a tank 16. A fuel inlet 15*b*, which constitutes a principle jet of the monostable fluid element 15, is connected with the discharging side of the oil pump 12, and a second outlet port 15*d* when an input signal is entered an input port 15*c* is connected with the pressurizing chamber 7 through a check valve 17 which allows fuel to pass into the pressurizing chamber 7. A spool valve piston 18 housed in the spool valve body 9 is leftwardly biased by means of a spring 19, and piston portions 18*a* and 18*b* split by the annular groove are designed to open the outlet 9*d* and the inlet 9*a* at the right-hand end of the piston and to close them at the left-hand end thereof. Above the nozzle 4 there is provided a chamber 22 which slidably accommodates a piston 21 for setting the opening pressure to open the nozzle, to form a pressurizing chamber 23 thereabove, which is connected with the discharging side of the oil pump 12. A lower chamber 24 is connected with the tank 16 through the drain pipe 13 and a lower chamber 25 of the servo-piston 5 is also connected with the tank 16 through the drain pipe 13.

Further, an accumulator 26 is provided on the discharging side of the oil pump 12 to maintain oil pressure constant, thus absorbing pulsation of fuel supplied under pressure by the operation of the unit injector.

With the above-described arrangement, the operation will now be described.

When an input signal is entered from the input port 15*c* of the monostable fluid element 15, the fuel supplied under pressure by means of the oil pump 12 through the inlet 15*b* flows and is deflected to flow towards the output port 15*d*. On the other hand, since the oil pressure does not act on the spool valve piston 18, the piston is moved leftwards through the action of the spring 19 to close the inlet 9*a* and the outlet 9*c*, and the fuel from the output port 15*d* enters the pressurizing chamber 7 through the check valve 17 to raise the fuel pressure within the pressurizing chamber 7, and the servo-piston 5 is then moved downwardly. Accordingly, since the check valve 11*a* is closed, the fuel within the pump plunger chamber 10 receives pressure corresponding to an area ratio between the servo-piston 5 and the pump plunger 6 and is fed into the injection nozzle 4, and when this pressure becomes higher than the pressure to open the nozzle determined by the oil pressure and the area under pressure of the pressurizing chamber 23, the fuel is injected from the injection nozzle. Then, when an input signal to the input port 15*c* of the monostable fluid element 15 is interrupted, the fuel supplied under pressure from the oil pump 12 passes through the output port 15*a* and the inlet 9*e* and then enters the spool valve body 9 to cause the spool valve piston 18 to overcome the force of the spring 19 and to move rightwards, and as a result the outlet 9*d* is opened to allow the fuel to return into the tank 16. At the same time the inlet 9*a* and the outlet 9*c* are opened and the pressurizing chamber 7 is connected with the fuel tank 16 for communication, then the fuel is supplied under pressure by the oil pump 12. The fuel enters the pump plunger chamber 10 through the check valve 11*a* to move the plunger 6 and the servo-piston 5 upwardly. Whereupon, a needle valve is closed by the pressure in the pressurizing chamber 23 and the injection nozzle 4 terminates its injection. As described above, it is understood that a time when the input signal to the input port 15*c* of the monostable fluid element 15 is interrupted corresponds to a time when the fuel is supplied into the pump plunger chamber 10, and a time when the input is applied corresponds to a time when fuel is injected. Therefore, the quantity of fuel injected is related to the time in which the input signal is applied to the fluid element, so that the quantity of the injection may be varied by varying said time and injection timing may be varied by varying timing in which the input signal is applied to the fluid element.

Since the injection characteristic may be varied by varying time and timing of the input signal applied to the fluid element, as mentioned above, the engine can be controlled by applying the optimum input for the characteristic required by the engine to the fluid element.

FIG. 2 illustrates a second embodiment of the present invention, in which a spool valve is actuated by an output of the fluid element to thereby operate the unit injector. In FIG. 2, like reference numerals designate corresponding parts to those in FIG. 1. The discharging side of the oil pump 12 is connected with the monostable fluid element 15 and a spool valve 29. This monostable fluid element 15 has the same construction as that shown in FIG. 1, and the spool valve 29 has three piston portions 38*a*, 38*b* and 38*c* which are divided by two annular grooves and are tightly sealed and slidably fitted in the valve body. The valve body is provided with an inlet 29*e* leading the output port -*a* of the fluid element 15 to the piston portion 38*a*, an outlet 29*d* opened and closed by means of the piston 38*a*, inlets 29*a* and 39*a* and outlets 29*c* and 39*c* opened and closed by means of the piston 38*b* and an outlet 29*b* opened and closed by means of the piston 38*c*. The outlets 29*d*, 29*c* and 29*b* are all connected with the fuel tank 16. The inlet 29*a* is connected with the oil pump 12 and both inlet 39*c* and outlet 39*a* are connected with the pressurizing chamber 7 of the servo-piston 5 in the injector 1. An inlet 29*f* leads to the other output 15*d* of the fluid element.

With the aforementioned construction, when the input signal 15*c* enters the fluid element 15, the principle jet 15*b* is deflected and enters the inlet 29*f* of the spool valve 29 from the output port 15*d* to act on the piston 38*c*, which is moved leftwards in the figure, and the piston 38*b* integral therewith opens the inlet 29*a* and the outlet 39*a*, while closing the inlet 39*c* and the outlet 29*c*. Similarly, the piston 38*a* integral therewith closes the outlet 29*d*. After these pistons have been actuated, the outlet 29*b* is opened. Therefore, fuel under pressure is supplied to the pressurizing chamber 7 in the injector through the inlets 29*a* and 39*a* for accomplishment of action similar to those as described with reference to FIG. 1, thereby injecting the fuel. When the input signal is removed from the fluid element, the principle jet acts on the piston 38*a* in the spool valve from the output port 15*a* to cause it to move rightwards, and as shown in the figure, fuel in the pressurizing chamber of the injector is pressed by the fuel pressure in the chamber 10 acting on the pump plunger 6 and is returned to the fuel tank 16 through the inlet 39*c* and the outlet 29*c* in the spool valve.

Although this invention has been described by way of the monostable fluid element in the aforementioned embodiments, a bistable fluid element may be used as shown in FIGS. 3 and 4. FIG. 3 illustrates a bistable type modified from the monostable fluid element as shown in FIG. 1, and FIG. 4 illustrates a bistable type modified from the monostable fluid element as shown in FIG. 2.

In FIGS. 3 and 4, when an input signal once enters from an input port 35*e* and even if the input signal is interrupted, fuel supplied under pressure through an inlet 35*b* flows towards an output port 35*f* to urge the spool valve piston 18 rightwards, and the pressurizing chamber 7 is connected with the fuel tank 16. When an input signal once enters from an input port 35*g* and even if the input signal is interrupted, fuel supplied under pressure through the inlet 35*b* flows towards an output port 35*h* and into the pressurizing chamber 7 to effect injecting the fuel.

As described above, the quantity of injection and timing of injection may be varied by varying an interval of the input signal alternately applied to the input ports 35*e* and 35*g*.

In accordance with this invention, the expected performance of the injector may readily be attained without using a magnet valve.

Many variations may be effected without departing from the spirit of this invention. It is to be understood that these, together with other variations in details, are anticipated by the appended claims.

What we claim is:

1. A unit injector for a diesel engine comprising, a main body comprising a cylinder, said cylinder having a large diameter portion and a small diameter portion, a servo-piston slidably fitted in said large diameter portion and a pump plunger connected with said servo-piston and slidably fitted in said small diameter portion, a pressurizing chamber being formed between the large diameter portion and the tip of said servo-piston, an injection nozzle connected at the end of said small diameter portion, a pump plunger chamber in communication with said injection nozzle and formed between said pump plunger and said injection nozzle, a fluid element and a spool valve body, said spool valve body being connected with said pressurizing chamber, means for supplying fuel under pressure to said fluid element, said fluid element having at least two outputs for selectively directionally controlling the supplied fuel, means to effect the injection stroke of said pump plunger when the fuel is supplied from one output of said fluid element, said spool valve being actuated by the supplied fuel pressure from another output of said fluid element to discharge the fuel in said pressurizing chamber and to supply the discharged fuel into said pump plunger chamber.

2. A unit injector for a diesel engine as in claim 1, wherein said fluid element is adapted to receive an input signal to effect which of said outputs thereof is operative.

3. A unit injection for a diesel engine as in claim 1, comprising a fuel tank wherein said spool valve comprises a first inlet port means connected to said pressurizing chamber, a first outlet port means connected to said fuel tank, and a slidable piston slidable to close the first outlet and inlet port means when said fuel in supplied to said pressurizing chamber and to open said first outlet and inlet port means when said fuel pressure is applied from said other output of said fluid element to said spool valve.

4. A unit injector for a diesel engine as in claim 3, wherein said spool valve comprises spring means biasing to place said slidable piston in position to close said first outlet and inlet port means.

5. A unit injector for a diesel engine as in claim 1, comprising an oil pump for supplying said supplied fuel pressure, a check valve connected between said oil pump and said pump plunger chamber, said check valve blocking fuel from flowing from said pump to said pump plunger chamber when the injection stroke of said pump plunger is effected and opening to permit fuel to flow into said pump plumger chamber when said spool valve is actuated by said other output of said fluid element.

6. A unit injector for a diesel engine as in claim 3, wherein said spool valve comprises a second inlet port means and a second outlet port means for receiving said fuel under pressure and returning the same to said fuel tank when said slidable piston moves to open said first inlet and outlet port means.

7. A unit injector for a diesel engine as in claim 1, wherein said spool valve comprises inlet and outlet port means, said slidable piston being controlled by fuel pressure to open one of said first or second inlet and outlet port means while closing the other of said first or second inlet and outlet port means.

* * * * *